US005540338A

United States Patent [19]

Stevens et al.

[11] Patent Number: 5,540,338

[45] Date of Patent: Jul. 30, 1996

[54] METHOD AND APPARATUS FOR DETERMINING THE ORIENTATION OF A DOCUMENT

[75] Inventors: Mark A. Stevens; William R. Lile, both of Medford, N.J.

[73] Assignee: Opex Corporation, Moorestown, N.J.

[21] Appl. No.: 382,656

[22] Filed: Feb. 2, 1995

Related U.S. Application Data

[63] Continuation of Ser. No. 114,196, Aug. 30, 1993, Pat. No. 5,397,003, which is a continuation of Ser. No. 720,413, Jun. 25, 1991, Pat. No. 5,240,116, which is a continuation-in-part of Ser. No. 363,511, Jun. 8, 1989, Pat. No. 5,115,918, which is a division of Ser. No. 904,966, Sep. 5, 1986, Pat. No. 4,863,037.

[51] Int. Cl.[6] ..... B07C 5/00

[52] U.S. Cl. ..... 209/534; 209/567

[58] Field of Search ..... 209/534, 567, 209/569, 570, 3.1, 3.3, 900, 540

[56] References Cited

U.S. PATENT DOCUMENTS

| | | |
|---|---|---|
| 771,852 | 10/1904 | Wolf et al. . |
| 2,806,614 | 9/1957 | Butz . |
| 2,894,626 | 7/1959 | Mulders et al. . |
| 2,947,406 | 8/1960 | Hazelton et al. . |
| 2,994,428 | 8/1961 | Daubendick ..... 209/567 X |
| 3,116,718 | 1/1964 | Krupotich et al. . |
| 3,146,902 | 9/1964 | Voelker . |
| 3,149,720 | 9/1964 | Woolfolk . |
| 3,238,926 | 3/1966 | Huck . |
| 3,266,626 | 8/1966 | Simjian . |
| 3,315,805 | 4/1967 | Brenner et al. . |
| 3,363,783 | 1/1968 | Rehm . |
| 3,384,252 | 5/1968 | West . |
| 3,386,574 | 6/1968 | Kaplan . |
| 3,509,535 | 4/1970 | Berube . |
| 3,523,687 | 8/1970 | Petersen et al. . |
| 3,622,151 | 11/1971 | Range et al. . |
| 3,629,822 | 12/1971 | Johnson . |
| 3,645,392 | 2/1972 | Chittenden et al. . |
| 3,750,880 | 8/1973 | Petrovsky et al. . |
| 3,808,926 | 5/1974 | Osland . |
| 3,884,010 | 5/1975 | Bardo et al. . |
| 3,895,220 | 7/1975 | Nelson et al. . |
| 3,912,909 | 10/1975 | Harrison . |

(List continued on next page.)

FOREIGN PATENT DOCUMENTS

| | | |
|---|---|---|
| 0169145 | 1/1986 | European Pat. Off. . |
| 0281007 | 9/1988 | European Pat. Off. . |
| 0399808 | 11/1990 | European Pat. Off. . |
| 1349353 | 12/1963 | France . |
| 2382951 | 10/1978 | France . |
| 2568232 | 1/1986 | France . |
| 62-127652 | 6/1987 | Japan . |
| 0153408 | 12/1961 | U.S.S.R. . |
| 1124099 | 8/1968 | United Kingdom . |
| 2121959 | 1/1984 | United Kingdom . |
| WO8600852 | 2/1986 | WIPO . |
| WO8801543 | 3/1988 | WIPO . |

OTHER PUBLICATIONS

Xerox Disclosure Journal (vol. 7, No. 1), Jan. 1982.

*Primary Examiner*—James R. Bidwell
*Attorney, Agent, or Firm*—Dann, Dorfman, Herrell & Skillman, P.C.

[57] ABSTRACT

To identify the orientation of specified documents, such as checks bearing magnetic ink markings, steps are taken to magnetize ink markings associated with the document, and to then detect magnetized ink markings on the document to develop electrical signals which can then be subjected to processing for identifying the orientation of the document based upon certain preestablished criteria. The result is a stand-alone device adapted to operate upon documents which are contained within envelopes to be subjected to an extraction procedure, prior to extraction from the envelopes, achieving a pre-processing of envelopes to identify those which contain the specified documents, and the orientation of the identified documents. The device is similarly adapted to operate upon the extracted documents, to identify those requiring special handling, and their orientation.

40 Claims, 3 Drawing Sheets

U.S. PATENT DOCUMENTS 3,938,435 2/1976 Suda et al. .
3,966,047 6/1976 Steiner .
3,978,450 8/1976 Sanner et al. .
3,979,884 9/1976 Russell .
4,016,708 4/1977 DeHart .
4,016,980 4/1977 DeHart et al. .
4,027,142 5/1977 Paup et al. .
4,053,737 10/1977 Lafevers et al. .
4,078,789 3/1978 Kittredge et al. .
4,080,528 3/1978 Kao et al. .
4,090,611 5/1978 McKinney .
4,107,653 8/1978 Kruklitis .
4,113,105 9/1978 DeHart et al. .
4,119,194 10/1978 Freeman et al. .
4,142,430 3/1979 Long et al. .
4,236,639 12/1980 Boettge et al. .
4,251,000 2/1981 Templeton .
4,255,652 3/1981 Weber .
4,262,895 4/1981 Wenthe, Jr. .
4,283,708 8/1981 Lee .
4,295,321 10/1981 DeHart et al. .
4,326,636 4/1982 Kawakami .
4,349,111 9/1982 Shah et al. .
4,356,473 10/1982 Freudenthal .
4,356,679 11/1982 Ellis et al. .
4,360,108 11/1982 Logothetis .
4,373,848 2/1983 Bishop .
4,378,109 3/1983 Takahashi et al. .
4,381,494 4/1983 Wisner .
4,388,793 6/1983 Kunne .
4,465,192 8/1984 Ohba et al. ..... 209/534
4,510,619 4/1985 LeBrun et al. .
4,542,829 9/1985 Emery et al. ..... 209/534
4,564,752 1/1986 Lepic et al. .
4,566,595 1/1986 Fustier .
4,584,529 4/1986 Aoyama ..... 209/567 X
4,625,497 12/1986 Owen .
4,625,870 12/1986 Nao et al. .
4,658,125 4/1987 Kachi et al. .
4,697,071 9/1987 Hiraoka et al. .
4,722,444 2/1988 Murphy et al. .
4,734,643 3/1988 Bubenik et al. ..... 209/567 X
4,749,087 6/1988 Buttifant .
4,764,725 8/1988 Bryce .
4,809,340 2/1989 Mersereau .
4,845,348 7/1989 Ho et al. .
4,863,037 9/1989 Stevens et al. .
4,924,088 5/1990 Carman et al. .
4,968,419 11/1990 Karalus et al. .
4,984,280 1/1991 Abe .
4,984,281 1/1991 Matsuhashi et al. .
4,993,556 2/1991 Gerlier .
4,993,700 2/1991 Winkler .
5,005,688 4/1991 Yukimoto et al. .
5,014,325 5/1991 Labarthe .
5,038,393 8/1991 Nanba .
5,063,599 11/1991 Concannon et al. .
5,068,519 11/1991 Bryce .
5,091,961 2/1992 Baus, Jr. .
5,115,918 5/1992 De Witt et al. .
5,119,954 6/1992 Svyatsky et al. .
5,134,663 7/1992 Kozlowsky .
5,240,116 8/1993 Stevens et al. .
5,259,490 11/1993 Gardellini .
5,397,003 3/1995 Stevens et al. ..... 209/534

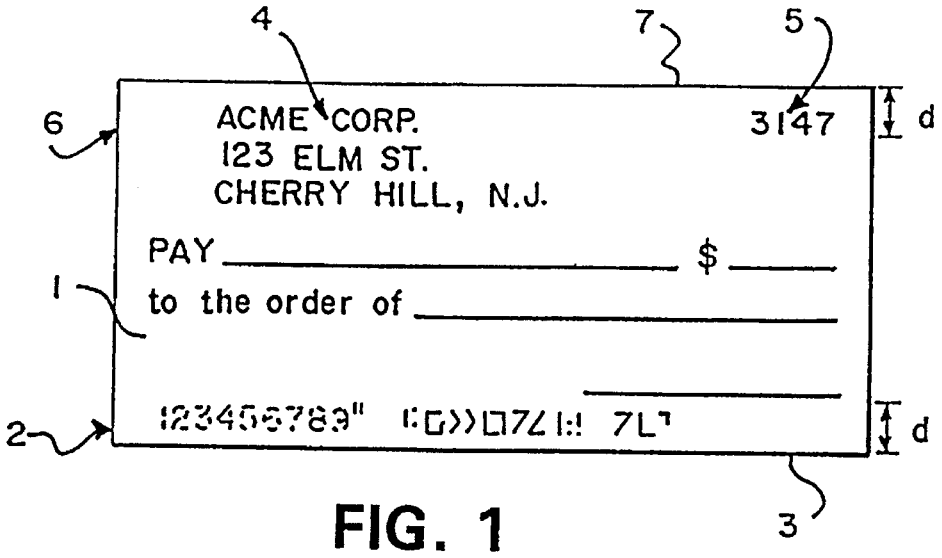
FIG. 1
FIG. 3
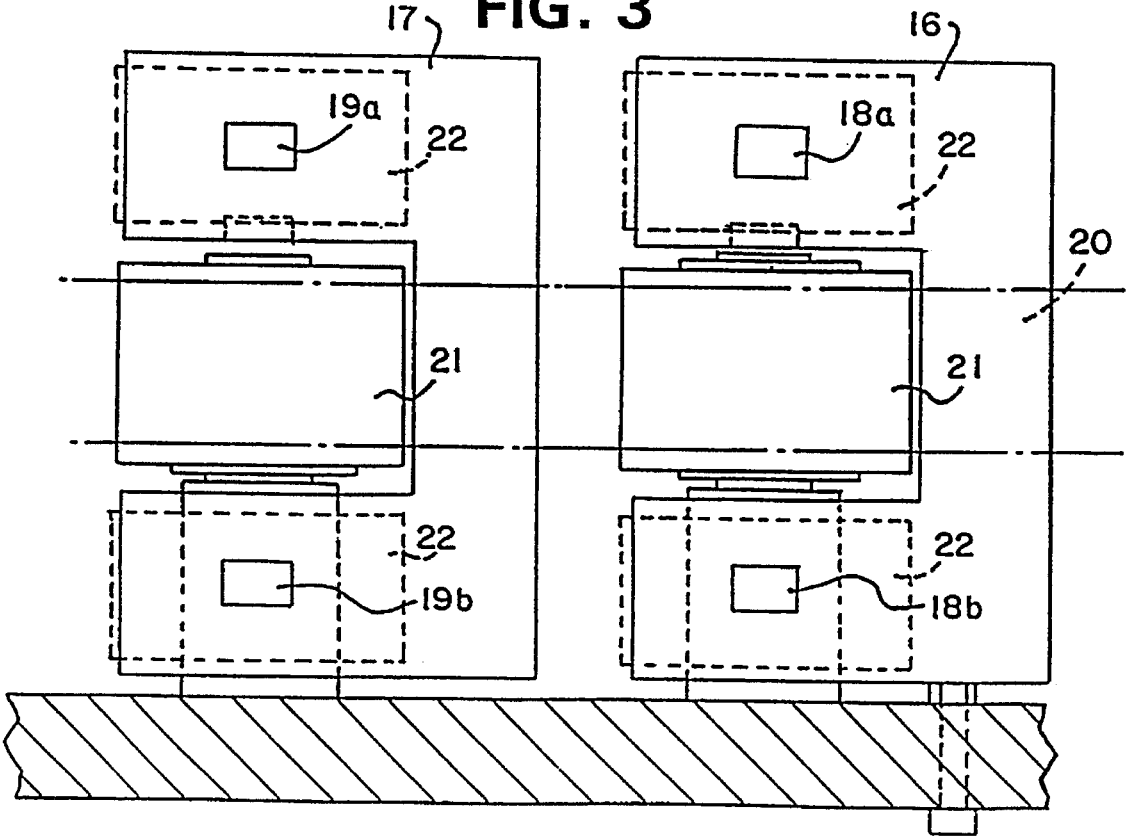

METHOD AND APPARATUS FOR DETERMINING THE ORIENTATION OF A DOCUMENT

RELATED CASES

This is a continuation of prior co-pending U.S. patent application Ser. No. 08/114,196, filed Aug. 30, 1993, and entitled "Method and Apparatus for Determining the Orientation of a Document," now U.S. Pat. No. 5,397,003, which is itself a continuation of U.S. patent application Ser. No. 07/720,413, filed Jun. 25, 1991, and entitled "Method and Apparatus for Determining the Orientation of a Document," now U.S Pat. No. 5,240,116, dated Aug. 31, 1993, which itself is a continuation-in-part of prior U.S. patent application Ser. No. 07/363,511, filed Jun. 8, 1989, and entitled "Apparatus for the Automated Processing of Bulk Mail and the Like," now U.S. Pat. No. 5,115,918, dated May 26, 1992, which is itself a divisional of U.S. patent application Ser. No. 06/904,966, filed Sep. 5, 1986, and entitled "Apparatus for the Automated Processing of Bulk Mail and the Like," now U.S. Pat. No. 4,863,037, dated Sep. 5, 1989.

BACKGROUND OF THE INVENTION

The present invention relates generally to the bulk processing of mail and the like.

For some time, various-devices have been developed to facilitate the extraction of contents from envelopes received in a mail room setting. Initially, this involved the development of devices which could be used to receive a plurality of envelopes for extraction of their contents, to serially sever envelope edges and expose the contents for presentation to an operator for manual extraction. One example of this type of apparatus which has found acceptance in the industry is the "Model 50" Rapid Extraction Desk which is manufactured by Opex Corporation of Moorestown, N.J. Later efforts turned to the bulk processing of mail, in fully automated devices which could receive large quantities of envelopes for serial delivery to an apparatus which could sequentially open the envelopes, extract their contents, and orient the extracted contents for subsequent stacking. One example of this type of apparatus which has found acceptance in the industry is the "Model 100" extraction system, which is also manufactured by Opex Corporation of Moorestown, N.J.

The availability of such devices, as well as the ever-present impetus to expedite the processing of certain types of mail (i.e., those containing an invoice and check for deposit), has led to the need for ancillary equipment capable of facilitating the pre-processing of sealed envelopes, prior to an extraction procedure, and the post-processing of documents, following an extraction procedure. In pre-sorting envelopes, it is important to identify envelopes containing checks, and which are therefore to be processed on an expedited basis (to expedite deposit of the extracted checks), as well as to identify the orientation of the checks contained within the envelopes to facilitate their subsequent extraction and processing. In post-sorting extracted documents, it is again important to identify extracted checks, and to identify the orientation of the extracted checks prior to stacking and subsequent processing.

Such pre-processing and post-processing is desirable to facilitate the handling of extracted checks, significantly expediting their processing for deposit (which is the overall objective of mail extraction procedures of this general type).

SUMMARY OF THE INVENTION

It is therefore the primary object of the present invention to provide an improved method and apparatus for determining the orientation of specified documents, primarily checks for deposit.

It is also an object of the present invention to provide a method and apparatus for determining the orientation of specified documents either prior to or subsequent to subjecting the documents to an extraction procedure.

It is also an object of the present invention to provide a method and apparatus for identifying the orientation of specified documents at different stages of a mail extraction procedure, separate from the devices which are used to actually perform the extraction procedure.

These and other objects are achieved in accordance with the present invention by providing a method and apparatus for identifying the orientation of specified documents bearing indicia which are capable of being operated upon by external stimuli. Primarily, this is directed to the magnetic ink markings of checks associated with a remittance processing operation. To this end, steps are taken to magnetize the ink markings associated with the document, and to then detect magnetized ink markings on the document to develop electrical signals which can then be subjected to processing for identifying the orientation of the document based upon certain preestablished criteria.

U.S. Pat. No. 4,863,037 discloses means for performing the foregoing operations in conjunction with an automated mail extraction procedure. In accordance with the present invention, steps are taken to isolate those portions of the apparatus disclosed in U.S. Pat. No. 4,863,037 which accomplish this task, for stand-alone operation. The resulting device is adapted to operate upon documents (primarily checks) which are contained within envelopes to be subjected to an extraction procedure, prior to extraction from the envelopes, achieving a pre-processing of envelopes to identify those which contain the specified documents, and the orientation of the identified documents. The device is similarly adapted to operate upon the extracted documents, to identify those requiring special handling, and their orientation. Irrespective of the manner in which the apparatus is employed, an effective stand-alone device is provided for determining the orientation of specified documents at desired stages of the mail extraction procedure.

For further detail regarding a preferred embodiment apparatus produced in accordance with the present invention, reference is made to the detailed description which is provided below, taken in conjunction with the following illustrations.

BRIEF DESCRIPTION OF THE DRAWINGS

FIG. 1 is a plan view illustrating a check for processing in accordance with the present invention.

FIG. 3 is a sectioned, elevational view of the detection fixture of FIG. 2, taken along the line 3—3.

In the several views provided, like reference numbers denote similar structures.

DETAILED DESCRIPTION OF THE INVENTION

Figure 2:
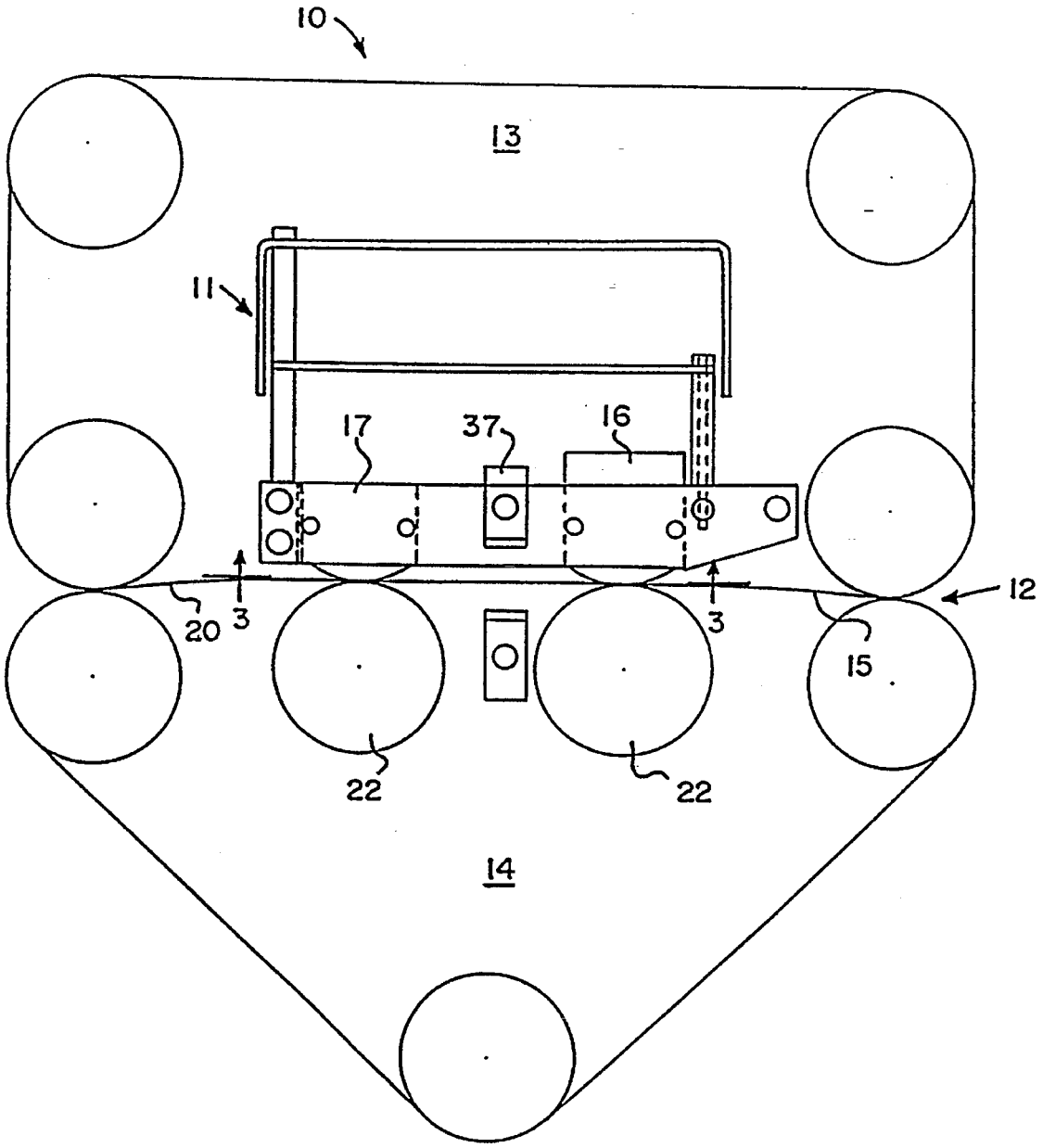
FIG. 2 is a top plan view of a detection fixture for processing documents in accordance with the present invention.

The improvements of the present invention are generally achieved by analyzing the "profile" of a check 1 as revealed by certain of its characteristic features. For example, with reference to FIG. 1, every check 1 must include a MICR (magnetic ink character recognition) "data line" for processing through the banking system. Moreover, this data line, shown at 2, is uniformly placed at a specified distance ("d") from the lower edge 3 of the check, and only the identifying characters which comprise this data line may be placed in this segregated band. This feature therefore constitutes a known characteristic which may serve as a primary basis for making determinations as to orientation. Most checks further include personalized identification fields such as the name of the account owner, and a checking account sequence number. If used, the account name is uniformly placed at 4, while the sequence number is uniformly placed at 5. It has been found that a second data line, shown at 6, which is also spaced at a specified distance ("d") from the top edge 7 of the check, will intersect with the fields 4, 5, if provided, and that only these identifying fields will be found in this segregated band. This feature therefore constitutes a known characteristic which may serve as a secondary basis for making determinations as to orientation. It has been found that by analyzing such characteristic features, along the data lines 2, 6, the orientation of a check 1 can be identified.

To accomplish this, a detection apparatus 10 is provided which, generally speaking, operates upon the magnetic ink which is traditionally used to print conventionally available checks. To be noted is that since the data lines 2, 6 which are to be operated upon are rather precisely spaced from the edges 3, 7 of the check 1 (by the specified distance "d"), it is important for the bottom-most edge of the document being scanned to be at a known and proper location. It is for this reason that the documents to be processed are preferably subjected to a justification step immediately proceeding their introduction to the detection apparatus 10, which may be accomplished either manually, in a tamping procedure, or automatically, making use of an edge justification device of the type disclosed in U.S. Pat. No. 4,863,037.

Referring now to FIGS. 2 and 3, upon entering the detection apparatus 10, documents are presented to a detection fixture 11, entering a nip 12 which is defined between an opposing pair of belt systems 13, 14 which serve to draw the received documents through the detection fixture 11, along a transport path 15. Positioned along the transport path 15 which is developed by the belt systems 13, 14 are a pair of fixtures 16, 17. The fixture 16 includes a pair of charge heads 18*a*, 18*b* which are capable of imparting a magnetic charge to the ink on the checks which are being passed through the detection fixture 11. Downstream from the fixture 16 is a second fixture 17, which includes a pair of read heads 19*a*, 19*b* which are responsive to flux variations resulting from the movement of charged characters (numerals or letters) past the heads 19. To be noted is that the charge heads 18*a*, 18*b* and the read heads 19*a*, 19*b* are respectively positioned above and below the belts 20 of the belt systems 13, 14, so that the heads 18*a*, 18*b*, 19*a*, 19*b* are exposed to the documents being conveyed through the detection fixture 11. Further to be noted is that the heads 18*a*, 18*b*, 19*a*, 19*b*, are vertically and symmetrically positioned along the fixtures 16, 17 so that the heads 18*a*, 18*b*, 19*a*, 19*b*, will be aligned with each of the data lines 2, 6 of the checks which are being processed through the detection fixture 11, irrespective of the orientation of each check as it progresses through the detection apparatus 10. The reasons for this will become apparent from the description which follows.

To enhance the reading of magnetic flux, it is important for each check to be maintained in proper association with the heads 18*a*, 18*b*, 19*a*, 19*b*, as the checks are drawn past the fixtures 16, 17. To this end, a pair of idler rollers 21 are preferably positioned in general alignment with the fixtures 16, 17 to enable careful adjustment of the belts 20 of the belt systems 13, 14 into alignment relative to the plane of the heads 18*a*, 18*b*, 19*a*, 19*b*. Paired rollers 22 are further preferably positioned in general alignment with, and spaced from (by a relatively small, adjustable gap) each of the heads 18*a*, 18*b*, 19*a*, 19*b*, on the opposite side of the transport path 15, to facilitate appropriate contact between the check 1 and the heads 18*a*, 18*b*, 19*a*, 19*b*. Non-magnetic leaf springs may also be used for this purpose. In any event, as a check is drawn through the detection fixture 11, the ink of the check is magnetized at 18*a*, 18*b* and read at 19*a*, 19*b* to provide electrical signals which can then be used to determine the orientation of the check.

In implementation, the detection fixture 11 may form part of a mail extraction apparatus, such as the "Model 100" extraction system manufactured by Opex Corporation of Moorestown, N.J. (and as disclosed in U.S. Pat. No. 4,863,037) or the "Model 50" Rapid Extraction Desk manufactured by that same company. The detection fixture 11 may also form part of a stand-alone apparatus useful in the pre-processing and post-processing of documents, if desired. For example, in some cases it may be desirable to present sealed envelopes to the detection fixture 11, prior to subjecting the envelopes to an extraction procedure, to identify envelopes containing checks (for expedited processing) and/or to identify the orientation of checks contained by the envelopes (to facilitate their subsequent processing). In other cases, it may be desirable to present extracted documents to the detection fixture 11, following an extraction procedure, to identify checks and/or their orientation to facilitate their subsequent processing.

Irrespective of its manner of implementation, the overall operation of the detection apparatus 10 remains unchanged since the detection fixture 11 is capable of operating either directly upon checks which are exposed to it, or indirectly upon checks contained within an envelope (and which are therefore separated from the detection fixture 11 by one or more paper thicknesses). The only potential variable is that of gain (in operating the charge heads 18*a*, 18*b* and/or the read heads 19*a*, 19*b*), which may be adjusted as needed and in accordance with the particular application involved. Upon detecting the orientation of a particular document, steps may be taken to either record the determined orientation (in memory for subsequent processing) or to develop electrical signals for presentation to document reorienting devices (inverting and/or reversing devices) such as are disclosed in U.S. Pat. No. 4,863,037.

Figure 4:
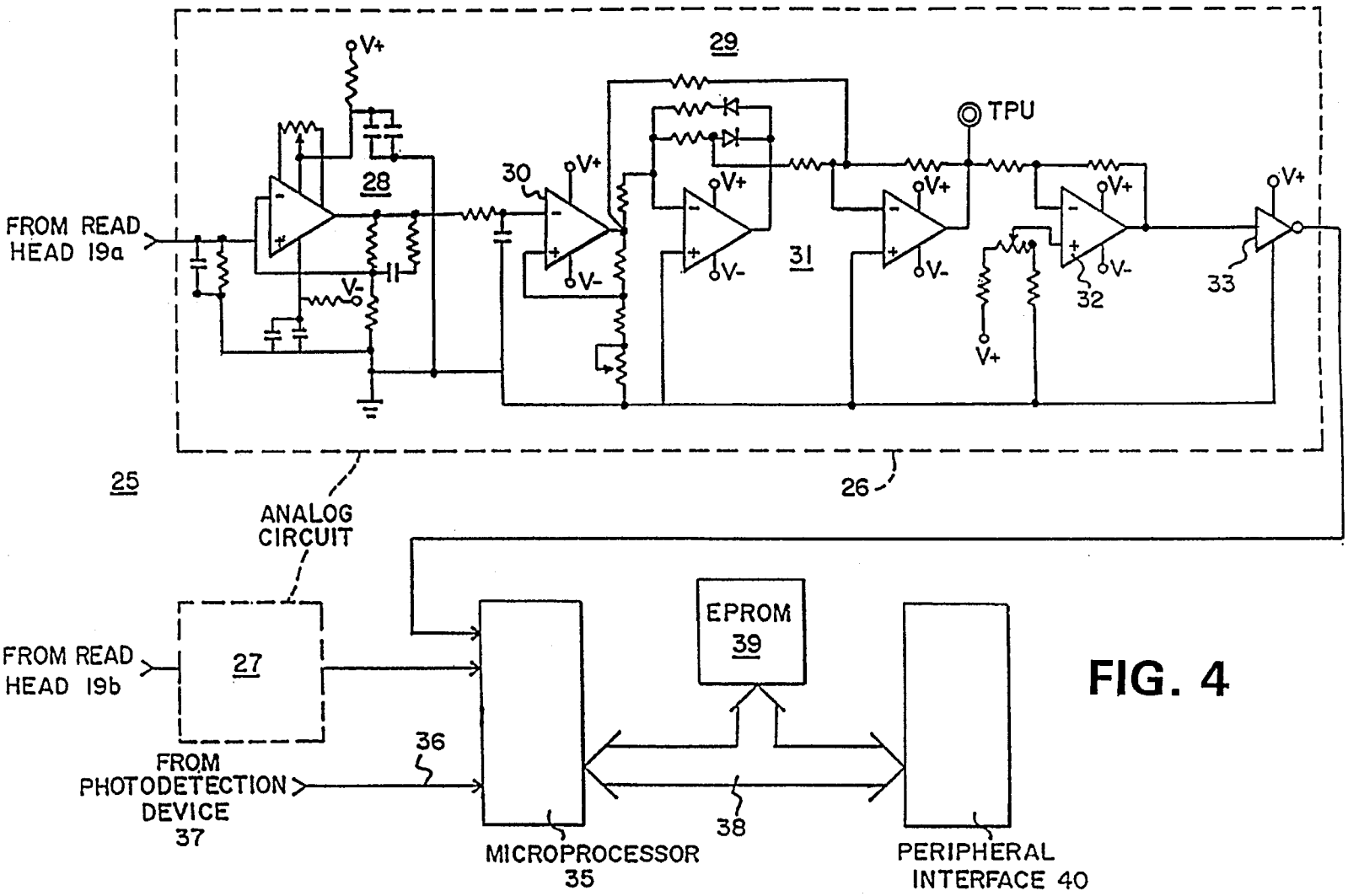
FIG. 4 is a schematic diagram showing a circuit for receiving and processing signals from the detection fixture of FIG. 2.

As documents pass the detection fixture 11 (irrespective of the manner in which the detection apparatus 10 is employed), electrical signals are developed for application to a detection circuit 25 such as is shown in FIG. 4. As previously indicated, a magnetic charge will first be imparted to any magnetic ink markings which are provided along the data lines 2, 6 of the check 1 being scanned as the check passes the charge heads 18*a*, 18*b*. This magnetic charge is preferably imparted to the magnetic ink using a permanent magnet, although electromagnetic means could be employed, if desired. To be noted is that an appropriate charge will be imparted to the magnetic ink characters on the check even if the magnetic ink is separated from the charge heads 18 by one or more paper thicknesses, since the desired charge will pass through the paper of the check, or an overlying envelope, as it passes the charge heads 18. Similarly, the read heads 19*a*, 19*b* will operate to read the magnetic markings either directly, or through the check (for post-processing), or through the overlying envelope (for preprocessing), for subsequent interpretation.

Each of the read heads 19*a*, 19*b* are separately coupled to a circuit 26, 27 for respectively processing the analog signals received from the uppermost read head 19*a* and the lowermost read head 19*b*. Each of the circuits 26, 27 are preferably positioned close to the read heads 19*a*, 19*b* to immediately amplify and process the signals which are received from the read heads 19*a*, 19*b* prior to their introduction to the remainder of the apparatus as will be described more fully below.

The circuits 26, 27 are identical in construction (only the circuit 26 is shown in detail to simplify the drawings), and each include a pre-amplifier 28 for immediately amplifying the signals received from the associated read head (in this case the read head 19*a*). The pre-amplified signal is then applied to a wave shaping circuit 29. Wave shaping circuit 29 includes an amplifier 30 for receiving signals from the pre-amplifier 28, a full-wave rectification circuit 31 which is coupled to the amplifier 30 to receive the amplified signal for full-wave rectification, preferably without any offset, and a differential amplifier 32 to set the final level for maximum noise immunity. Lastly, the wave shaping circuit 29 communicates with a Schmitt trigger circuit 33 which readies the amplified signal for digital processing.

A microprocessor 35 is provided to receive the various signals derived from the read heads 19*a*, 19*b* via the analog circuits 26, 27, to provide outputs which are indicative of the orientation of the check passing through the detection fixture 11 as will be described more fully below. To this end, the signals from the Schmitt trigger circuits 33 of the analog circuits 26, 27 are applied to the microprocessor 35. Also applied to the microprocessor 35 is an enabling signal 36 which is indicative of the passage of a check through the detection fixture 11, and which serves to initiate the orientation detection scheme to be described below. Passage of the check (the leading edge) through the detection fixture 11 may be detected by various means, such as a photodetection device 37 (see FIG. 2) positioned between the charge heads 18*a*, 18*b* and the read heads 19*a*, 19*b*. A common buss 38 operatively connects the microprocessor 35 with EPROM 39, and a peripheral interface 40 for enabling communication with ancillary equipment 41 (e.g., data recorders or equipment for reorienting documents).

The detection circuit 25 can operate to determine the orientation of two different types of checks including standard personal checks, which never vary in size, as well as commercial checks, which are nearly standard but which may vary to some extent. This is accomplished by magnetizing the ink of the check as previously described, and by reading the magnetized ink as the check passes through the detection fixture 11. Symmetrically paired, upper and lower charge heads 18*a*, 18 and read heads 19*a*, 19*b* are provided to enable the desired data to be obtained in a single pass of the check through the detection fixture 11, irrespective of its orientation.

The decision as to the orientation of a check relative to the detection fixture 11 is based not upon an attempt to read portions of the MICR data line 2, but rather results from an interpretive process which is performed within the microprocessor 35. To this end, beginning at a set time after the leading edge of a check passes the photodetection device 37 (to account for the distance between the photodetection device 37 and the read heads 19*a*, 19*b*), data is provided to the microprocessor 35 which is indicative of the presence or absence of characters encountering the read heads 19*a*, 19*b*. The microprocessor 35 then operates to monitor the length of "continuous" data fields which are encountered at the read heads 19*a*, 19*b*, as well as discontinuities which exist between such data groupings, in accordance with procedures which are presently employed in the above-discussed "Model 100" extraction system. However, for purposes of explanation, a summary of these procedures is provided below.

Within the microprocessor 35, a series of counters are developed to monitor the lengths of marking groups read from the check being scanned, as well as gaps between such marking groups. Separate counters are provided to interpret the data being received from the upper read head 19*a* and the lower read head 19*b*. Since the characters on the data line 2 are conventionally provided at one-eighth inch spacings, a corresponding sampling period is established by the microprocessor 35. If, during the sampling period, a character is passing the read head 19*a* or 19*b*, the microprocessor 35 will operate to count a marking for the corresponding data link. If, during the sampling period, a character does not pass the read head 19*a* or 19*b*, the microprocessor 35 will operate to count a space for the corresponding data line.

For encountered markings, the appropriate marking counter is incremented. If a space counter ever counts more than a specified number (e.g., six) of spaces prior to a resumption of encountered markings, the occurrence is designated as a gap. The appropriate gap counter is incremented and the space counter and marking counter are reset to zero. If markings are again encountered before the space counter counts the specified number of spaces, the occurrence is not designated as a gap, but rather is designated as a space within the marking group. In such cases, the value of the space counter is added to the marking counter, and the space counter is reset to zero. Thus, the encountered spacing is treated as part of a continuous marking group. The various counters proceed in this fashion to identify the length of the last encountered marking group, and the number of any gaps, on each of the data lines 2, 6 of the check 1 being scanned. These values are then used to make a determination as to the orientation of the check 1 based upon various stored, empirically determined criteria (EPROM 39) within the microprocessor 35.

For example, if it is determined that the upper gap counter is non-zero and the lower gap counter is zero, while the upper pulse counter is greater than nine and the lower pulse counter is at least twenty-two, then the check has passed through the detection fixture 11 while upright and facing away from the read heads 19*a*, 19*b*. If it is determined that the lower gap counter is non-zero and the upper gap counter is zero, while the lower pulse counter is less than seven and the upper pulse counter is at least twenty-two, then the check has passed through the detection fixture 11 while inverted and facing away from the read heads 19*a*, 19*b*. If it is determined that the lower gap counter is non-zero and the upper gap counter is zero, while the upper pulse counter is at least twenty-two and the lower pulse counter is greater than nine, then the check has passed through the detection fixture 11 while inverted and facing the read heads 19*a*, 19*b*. Lastly, if it is determined that the upper gap counter is non-zero and the lower gap counter is zero, while the upper pulse counter is less than seven and the lower pulse counter is at least twenty-two, then the check has passed through the detection fixture 11 while upright and facing the read heads 19*a*, 19*b*.

The above criteria assume that a check having the characteristic features 2, 4, 5 has passed through the detection apparatus 10. However, other types of documents can also be sensed in accordance with the present invention, if desired. For example, in the event that all gap and pulse counters equal zero, it can be assumed that the document is not a check, but rather is a corresponding invoice passing through the detection apparatus 10.

In the event that the document is a check, but does not include either of the fields 4, 5, different criteria may be devised to establish the orientation of such documents. For example, assume that a check does not include a sequence number at 5. Such a document can be analyzed provided a count is made of the gap which extends between the leading edge of the document and the first detected marking group. This may be accomplished by retaining the data which is developed from the start of the count (responsive to the photodetection device 37) to the first encountered marking group. If it is determined that the lower gap counter exceeds the lower leading edge gap counter, the lower pulse counter exceeds twenty-three and the lower pulse counter exceeds the upper pulse counter, then the check has passed through the detection fixture 11 while upright and facing the read head 19. If it is determined that the upper leading edge gap counter exceeds the upper gap counter, the upper pulse counter exceeds twenty-three and the upper pulse counter exceeds the lower pulse counter, then the check has passed through the detection fixture 11 while inverted and facing the read heads 19*a*, 19*b*. If it is determined that the upper gap counter exceeds the upper leading edge gap counter, the upper pulse counter exceeds twenty-three and the upper pulse counter exceeds the lower pulse counter, then the check has passed through the detection fixture 11 while inverted and facing away from the read head 19*a*, 19*b*. Lastly, if it is determined that the upper leading edge gap counter exceeds the upper gap counter, the lower pulse counter exceeds twenty-three and the lower pulse counter exceeds the upper pulse counter, then the check has passed through the detection fixture 11 while upright and facing away from the read heads 19*a*, 19*b*.

Other detection schemes (criteria) may be derived to determine the orientation of still other types of checks in similar fashion.

It will therefore be understood that various changes in the details, materials and arrangement of parts which have been herein described and illustrated in order to explain the nature of this invention may be made by those skilled in the art within the principle and scope of the invention as expressed in the following claims.

What is claimed is:

1. An apparatus for determining the orientation of a document receivable in differing orientations relative to said apparatus, said document including magnetic ink markings on a surface of the document, and said apparatus comprising:

a) a magnetizing element for magnetizing the magnetic ink markings on said document;

b) a magnetic detector for detecting magnetized ink markings on said document; and c) orientation-determination means for determining that said document is in any one of at least three defined orientations.

2. The apparatus of claim 1 including orientation-identifying means for identifying documents in one determined orientation.

3. A method for determining the orientation of a document receivable in differing orientations, said document including groups of magnetic ink markings asymmetrically disposed along two separate linear portions of the document, said method comprising the steps of:

a) magnetizing the groups of magnetic ink markings on the two separate linear portions of said document;

b) detecting the locations of groups of magnetized ink markings on said document; and c) determining that said document is in a first defined orientation, or that said document is in a second defined orientation different from the first orientation on the basis of the detected location and asymmetric arrangement of the groups of magnetic ink markings.

4. The method of claim 3 including the step of identifying documents in said first orientation and documents in said second orientation and providing said identification to an apparatus for orienting the documents to have a single orientation.

5. The method of claim 3, including the steps of:

initially receiving the document contained within an envelope; and maintaining said document within the envelope during said magnetizing and detecting steps.

6. The apparatus of claim 1, comprising a photodetection device for detecting the presence of the document in the vicinity of the magnetic detector and for responsively producing a detection signal; and wherein said orientation-determining means is responsive to the detection signal to perform said determination.

7. The apparatus of claim 1 wherein said magnetic detector comprises a pair of magnetic heads spaced apart by a separation distance corresponding to an arrangement of separate lines of magnetic markings on a standard check.

8. The apparatus of claim 7 wherein said orientation-determination means comprises measuring means for measuring distances between groups of said magnetic markings.

9. The apparatus of claim 8 wherein said orientation-determining means comprises comparison means responsive to said measuring means for comparing the distances measured by said measuring means with predetermined criteria corresponding to distances between groups of markings on a standard check.

10. The apparatus of claim 9 wherein said measuring means is configured for recording distance indicia in separate registers corresponding to the respective magnetic heads, and wherein said comparison means is responsive to said separately recorded indicia for determining the orientation of the document when the document is a check.

11. The apparatus of claim 1 wherein said orientation-determining means is configured for determining that said document is in at least one of four orientations.

12. The apparatus of claim 11 wherein said orientation-determining means is further configured for indicating that no magnetic markings are detected on the document by the magnetic detector.

13. The apparatus of claim 1 wherein said magnetizing element and said detector are adapted for magnetizing and detecting said magnetic markings through a thickness of one or more sheets of paper.

14. The apparatus of claim 13 wherein said one or more sheets of paper comprises an envelope containing the document.

15. The apparatus of claim 1 comprising document transporting means for transporting said document from the vicinity of said magnetic detector to an apparatus for orienting said document to have a predetermined one of said defined orientations.

16. The apparatus of claim 1 comprising transport means for transporting the document through the apparatus such that the document is transported sequentially past the magnetizing element and the magnetic detector.

17. The apparatus of claim 16 wherein said orientation-determining means is configured for determining said one of at least three orientations in response to a single pass of said document through the apparatus.

18. The apparatus of claim 17 wherein said orientation-determining means is configured for determining that said document is in at least one of four orientations.

19. The apparatus of claim 17 wherein said magnetic detector comprises a pair of magnetic heads spaced apart by a separation distance corresponding to an arrangement of separate lines of magnetic markings on a standard check.

20. The apparatus of claim 19 wherein said magnetizing element and said detector are configured for magnetizing and detecting said magnetic markings through a thickness of one or more sheets of paper.

21. The apparatus of claim 20 wherein said one or more sheets of paper comprises an envelope containing the document.

22. The apparatus of claim 21 wherein said orientation-determining means is configured for indicating that no magnetic markings are detected on the document by the magnetic detector.

23. An apparatus for determining the orientation of a standard check and for communicating the result of such determination to ancillary equipment, the apparatus comprising:

a transport for transporting the check along a guide path;

a pair of magnetic charge heads positioned along the guide path, for magnetizing magnetic ink markings located on the check along respective bands provided by a standard spacing of magnetic ink markings on checks;

a pair of magnetic read heads positioned along the guide path, each read head for producing a read signal in response to the magnetized ink markings within said respective bands of the check in the proximity of the heads;

a signal processing circuit for receiving each of the read signals and for converting each of the read signals to a logic-level signal;

a photodetection device positioned along the guide path for detecting the presence of the check in the vicinity of the read heads and for producing an enabling signal in response to the presence of a check;

a memory for storing orientation criteria defining at least one orientation of a standard check;

a microprocessor connected with the memory and connected to receive the logic-level signals and the enabling signal, the microprocessor having:

timing means for establishing a plurality of sampling intervals, retrieving means for retrieving said orientation criteria from the memory, determining means for determining the condition of the logic-level signals at each sampling interval in response to the enabling signal, comparison means for comparing the determined condition of the logic level signals with said orientation criteria, and output means responsive to said comparison means for providing an output signal indicating that the check is in the at least one orientation; and connection means connected to receive the output signal from said microprocessor, and connected for providing the output signal to the ancillary equipment.

24. The apparatus of claim 23, wherein said transport comprises a pair of opposing belts for engaging the check therebetween.

25. The apparatus of claim 24, comprising an edge justification device for aligning the check within the guide path prior to engagement with the opposing belts.

26. The apparatus of claim 23, wherein said memory is a read-only memory adapted to store said orientation data as a profile of marking groups located along the respective bands of standard checks.

27. A method, comprising:

(a) transporting a standard check along a guide path;

(b) exposing a pair of separate bands along respective upper and lower portions of the check to a magnetic field as the check is transported along the guide path;

(c) detecting the presence of the check at a predetermined location along the guide path and producing a detection signal in response thereto;

(d) reading magnetic flux variations at a pair of reading locations positioned along the guide path at locations corresponding to the separate bands, and producing a pair of read signals in response thereto;

(e) determining, on the basis of said detection signal, that the bands are being transported along the guide path in the vicinity of the reading locations and comparing the read signals with orientation criteria defining selected orientations of a standard check;

(f) determining whether the check is in one of the selected orientations; and (g) producing an orientation signal identifying the determined orientation of the check.

28. The method of claim 27, comprising the step of re-orienting the check to conform with a desired orientation in response to the orientation signal.

29. The method of claim 28, comprising the steps of:

initially providing the check within an envelope; and extracting the check from the envelope after said re-orienting step.

30. The method of claim 29, comprising the step of determining whether the envelope contains the check during said reading step.

31. The method of claim 27, comprising the step of initially providing said check within an envelope and maintaining said check within the envelope during steps (a)–(g).

32. The method of claim 27, comprising the steps of:

maintaining said orientation criteria within a read-only memory and retrieving said orientation criteria for use during said determining step (e).

33. The method of claim 27 wherein said determining step (f) is performed after a single execution of said reading step (d).

34. A method of processing a plurality of documents comprising documents with magnetic ink markings and documents without magnetic ink markings, the method comprising:

transporting each of said documents along a guide path;

magnetizing each of said documents along two separate bands;

determining whether magnetized magnetic ink markings are present on each of the documents;

detecting the locations of groups of magnetized magnetic ink markings within the two separate bands on documents having magnetic ink markings;

comparing the detected locations of groups of magnetic ink markings with orientation criteria defining selected orientations of the documents having magnetic ink markings; and producing an identification signal for each document, said identification signal indicating whether a document bears magnetic ink markings and indicating a selected orientation of each document having magnetic ink markings.

35. The method of claim 34, comprising the steps of initially providing each of said documents within an envelope.

36. The method of claim 35, comprising the step of justifying the documents prior to transporting the documents along the guide path.

37. The method of claim 36, wherein said justifying step comprises the step of tamping the documents.

38. The method of claim 34, comprising the step of orienting each document having magnetic ink markings according to a desired orientation for all documents having magnetic ink markings.

39. The method of claim 38, comprising the step of extracting the documents from the envelope after said orienting step.

40. The method of claim 34 wherein said magnetizing step comprises magnetizing at least one document through a thickness of paper constituting the document.

* * * * *